US010871278B1

(12) United States Patent
Zoltie

(10) Patent No.: US 10,871,278 B1
(45) **Date of Patent: *Dec. 22, 2020**

(54) ILLUMINATED FLAG

(71) Applicant: Lizal, Inc., Cupertino, CA (US)

(72) Inventor: Alan Zoltie, Vashon, WA (US)

(73) Assignee: Lizal, Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/887,146

(22) Filed: May 29, 2020

Related U.S. Application Data

(63) Continuation of application No. 16/817,645, filed on Dec. 18, 2019, now Pat. No. 10,697,621.

(51) Int. Cl.

| | |
|---|---|
| ***F21V 23/00*** | (2015.01) |
| ***G09F 13/00*** | (2006.01) |
| ***G09F 17/00*** | (2006.01) |
| ***E04H 12/32*** | (2006.01) |
| ***F21S 8/08*** | (2006.01) |
| ***F21S 9/00*** | (2006.01) |

(52) U.S. Cl.
CPC ..... *F21V 23/001* (2013.01); *E04H 12/32* (2013.01); *F21S 8/085* (2013.01); *F21S 9/00* (2013.01); *G09F 13/00* (2013.01); *G09F 17/00* (2013.01)

(58) Field of Classification Search
CPC ..... F21V 23/001; F21V 21/088; F21S 9/00; F21S 8/085; E04H 12/32; G09F 13/00; G09F 2017/0033; G09F 17/00; F21W 2131/10; F21L 4/02; Y02B 20/72
See application file for complete search history.

(56) References Cited

U.S. PATENT DOCUMENTS

| | | | | |
|---|---|---|---|---|
| 2,280,817 | A | 4/1942 | Freeman | |
| 4,164,008 | A | 8/1979 | Miller | |
| 5,477,437 | A * | 12/1995 | Lach | G09F 17/00 362/249.16 |
| 6,256,811 | B1 * | 7/2001 | Nelson | A47C 19/022 362/130 |
| 7,192,168 | B2 | 3/2007 | Day | |
| 7,236,146 | B2 | 6/2007 | Smedley | |
| 8,146,278 | B1 | 4/2012 | Grant | |
| 9,860,998 | B2 * | 1/2018 | Malik | G09F 9/301 |
| 10,697,621 | B1 * | 6/2020 | Zolte | F21S 9/00 |
| 2004/0083633 | A1 | 5/2004 | Mueller | |
| 2008/0104870 | A1 | 5/2008 | Alden | |
| 2012/0113625 | A1 | 5/2012 | Werner | |
| 2014/0340234 | A1 | 11/2014 | Wojnarski | |

FOREIGN PATENT DOCUMENTS

| | | |
|---|---|---|
| DE | 19632719 | 2/1988 |
| WO | WO2014185965 | 5/2014 |

* cited by examiner

*Primary Examiner* — Peggy A Neils
(74) *Attorney, Agent, or Firm* — Maskell Law PLLC; Benjamin E. Maskell

(57) ABSTRACT

Disclosed is an illuminated flag including a flag, a first layer of the flag, a second layer of the flag, a light disposed between the first layer of the flag and a second layer of the flag, a flag clamp, and a wire extending from the light and into an interior space of the flagpole.

20 Claims, 8 Drawing Sheets

ILLUMINATED FLAG

This application is a continuation of U.S. application Ser. No. 16/718,645, filed Dec. 18, 2019, the entirety of which is hereby incorporated by reference.

BACKGROUND OF THE INVENTION

Field of the Invention

The embodiments of the invention relate lighted flags, and more particularly, to a flag having powered lights embedded in the flag. Although embodiments of the invention are suitable for a wide scope of applications, it is particularly suitable for reliably providing electrical power from a flagpole to lights in a flag.

Discussion of the Related Art

Few lighted flags exist in the related art. This primarily stems from the engineering challenges of reliably providing electrical power from a rigid flagpole to a non-rigid flag that might move or flap in the wind as would a traditional flag.

One such solution of related art is described in U.S. Pat. No. 8,146,278 of Grant et. al. ("Grant") which describes a flag formed from a rigid box. The rigid box of Grant can have transparent side panels and internal lighting to illuminate the side panels. Power for the lighting of Grant can be provided by an electrical cable running directly to the flag. The flag of Grant can be mounted to a flagpole with rings.

U.S. Pat. No. 2,280,817 of Freeman ("Freeman") also relates to a rigid flag having neon tubing for illumination. Freeman discloses that a flag can be connected to a flagpole with rings and neon lights in the flag can be powered by a wire connected to a rotating connector on the flagpole.

U.S. Pat. No. 7,192,168 of Day ("Day") relates to an illuminated flag constructed from a pliable material with internal stiffening members and that power to the flag can be provide by directly plugging the flag into a power source in much the same way as Grant.

The related art, however, suffers from may drawbacks that limit viable applications of illuminated flags. First, the flags of Grant and Freeman are rigid. Day even discloses that rigid members should be added to the flags. It is preferable however, that illuminated flags are substantially similar in appearance and behavior to non-illuminated flags. Second, each of Grant, Freeman, and Day disclose powering a flag by an exposed wire running from the flag directly to a power source. The wire can be unsightly and present a messy appearance. Additionally, an exposed wire can be subject to damage and tangling thereby complicating the safety and efficacy of a lighted flag. Accordingly, there is a need for an illuminated flag that solves the aforementioned problems of the related art.

SUMMARY OF THE INVENTION

Accordingly, embodiments of the invention are directed to a [title of invention] that substantially obviates one or more of the problems due to limitations and disadvantages of the related art.

An object of embodiments of the invention is to provide a pliable illuminated flag.

Another object of embodiments of the invention is to provide an illuminated flag having a protected power supply.

Yet another object of embodiments of the invention is to provide an illuminated flag using inexpensive materials.

Still another object of embodiments of the invention is to provide a portable illuminated flag coupled to an illuminated flagpole.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, an illuminated flag includes a flag, a first layer of the flag, a second layer of the flag, a first light in the flagpole, a second light disposed between the first layer of the flag and a second layer of the flag, a flag clamp, a notch in the flag clamp, a wire extending from the second light, through the notch in the flag clamp, and into an interior space of the flagpole.

In another aspect, an illuminated flag includes a flagpole, the flagpole having a hollow interior and at least partially translucent, a flag, the flag that is at least partially translucent, a first layer of the flag, a second layer of the flag, a plurality of lights disposed between the first layer and the second layer of the flag, an anchor connecting the flag to the flagpole, a discontinuous portion of the anchor, a wire for providing power to the plurality of lights, wherein the wire is routed from the flag to the flagpole through the discontinuous portion of the anchor.

In yet another aspect, an illuminated flag includes a hollow flagpole, a flag formed from two layers of material, a first layer of the flag, a second layer of the flag, a light disposed between the first layer and the second layer of the flag, an anchor connecting the flag to the flagpole, a slot in the flagpole retaining the anchor, a protrusion of the anchor, a mating portion of the flag disposed in relative position to correspond to the protrusion of the anchor and secure the flag to the anchor, a notch of the anchor, a wire connected to the light, the wire substantially obscured between the first and second layers of the flag and routed through the notch of the anchor into the hollow flagpole.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
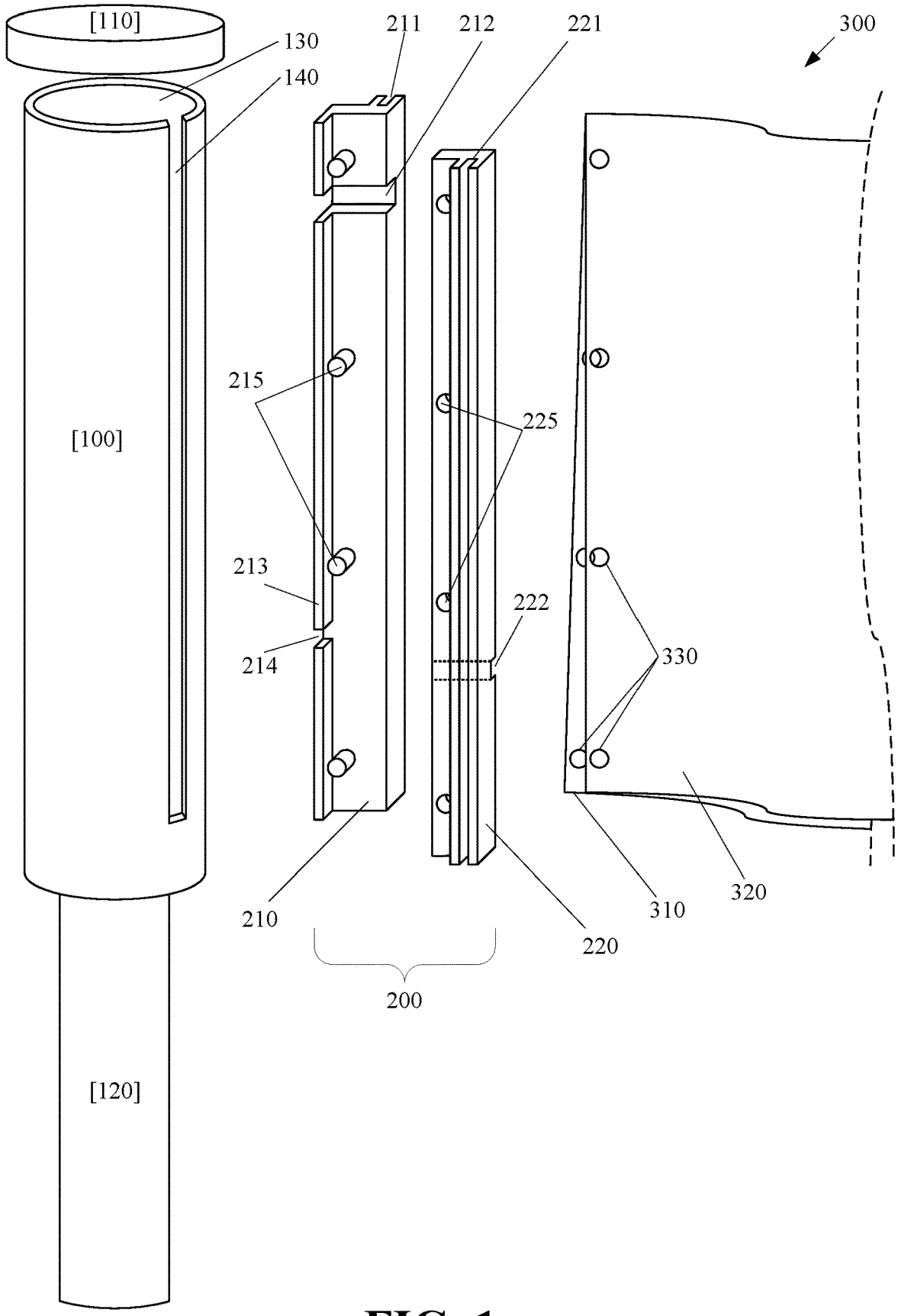
FIG. 1 is an exploded view of mechanical components of an illuminated flag according to an exemplary embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

FIG. 1 is an exploded view of mechanical components of an illuminated flag according to an exemplary embodiment of the invention. As shown in FIG. 1, an illuminated flag includes a flagpole 100, a flag clamp 200, and a flag 300. The pole 100 can further include a cap 110, a handle 120, a hollow interior 130, and a longitudinal slot 140. The flag clamp 200 can be formed from a first member 210 and a second member 220. The first member 210 can have a longitudinal channel 211, a notch 212, a spine 213 having a discontinuous portion 214, and upstanding pillars 215. The second member 220 can have a longitudinal channel 221, a notch 222, and holes 225. The flag 300 can have a first layer 310, a second layer 320, and holes 330.

The flagpole (or pole) 100 can be formed from a transparent or translucent material. The flagpole 100 can have a hollow interior 130. The hollow interior 130 can house electronics or lights (not shown). The flagpole 100 can have a handle 120. The handle 120 can house electronics or lights (not shown). The flagpole 100 can have a longitudinal slot 140. The longitudinal slot 140 can penetrate an exterior surface of the flagpole 100 to the hollow interior 130. The longitudinal slot 140 can extend substantially the length of the flagpole 100 and start near the handle 120 and extending through, and open to, a top end of the flagpole 100. The cap 110 can be affixed to a top of the flagpole 100 to close the longitudinal slot 140. The cap 110 can be affixed with glue, threads, screws, or other mechanical fastening means known in the art.

The longitudinal slot 140 can be sized in relative proportions to slidably receive the flag clamp 200. Longitudinal channels 211 and 221 of the flag clamp 200 can slidably engage the sides of the longitudinal slot 140 to retain the flag clamp 200 in the flagpole 100. The flag clamp 200 can be inserted into the flagpole 100 by inserting the flag clamp 200 into the longitudinal slot 140 so that the longitudinal channels 211 and 221 of the flag clamp 200 slide on the sidewalls of the longitudinal slot 140. The flag clamp 200 can be secured in the slot by the cap 110. The sidewalls of the longitudinal slot 140 can prevent the flag clamp 200 from separating thereby retaining the flag 300 within the clamp.

The flag clamp 200 can be formed from clamp members 210 and 220 which can sandwich together to retain the flag 300. The flag clamp 200 can be an anchor that attaches the flag 300 to the flagpole 100. The first clamp member 210 can have longitudinal channel 211 running substantially the length of the first clamp member 210. The first clamp member 210 can have a spine 213. The spine 213 can provide rigidity to the clamp member 200. The first clamp member 210 can have a groove 212. The groove 212 can be sized in approximate proportions to accommodate an electrical wire (not shown) to pass therethrough. The spine 213 of the first clamp member 210 can also have a discontinuous portion 214. The discontinuous portion 214 can be sized in approximate proportions to accommodate an electrical wire (not shown) to pass therethrough.

The first clamp member can have upstanding members 215. The upstanding members 215 can be sized in approximate proportions and disposed in approximate locations to engage a corresponding plurality of mating members 225 on the second clamp member 220. Although the upstanding members 215 and mating members 225 have been illustrated as pillars and holes in the embodiments illustrated in FIG. 1, other configurations of upstanding members and mating members are contemplated and within the scope of the invention including, for example, teeth, ridges, pillars or other features on the first clamp member 210 that mate with corresponding features on the second clamp member 220.

The second clamp member 220 can also have a longitudinal channel 221 running substantially the length of the second clamp member 220. The second clamp member 220 can have a groove 222. The groove 222 can be sized in approximate proportions to accommodate an electrical wire (not shown) to pass therethrough. Although the embodiment shown in FIG. 1 has been illustrated as having grooves 212 and 222 and discontinuous portion 214, the invention is not limited to these configurations of grooves and discontinuations portions and may implement varying combinations of grooves and discontinuations portions. By way of non-limiting example, embodiments of the invention can include only groove 212 and omit groove 222 and discontinuous portion 214. In another non-limiting example, embodiments of the invention can include only groove 222 and discontinuous portion 214 while omitting groove 212. In still other embodiments of the invention, the flag clamp can include discontinuous portion 214 and can omits grooves 212 and 222. In still other embodiments of the invention, a discontinuous portion may be formed as part of a notch to allow a wire to pass therethrough.

When assembled, a portion of the flag 300 can be disposed between the two flag clamp members 210 and 220. The flag 300 can preferably have an engaging portion such as holes 330 that positively mate with corresponding features of the flag clamp 200 to secure the flag 300 within the flag clamp 300. Although the engaging portion of the flag 300 is illustrated in FIG. 1 as holes 330, other types of engaging portions are contemplated and within the scope of the invention including ridges, slots, grooves, and abrasive patches. It is further contemplated that the flag may omit engaging portions and instead by secured in the flag clamp with glue or adhesives.

The flag 300 can be formed from two layers 310 and 320. The layers 310 and 320 can be ultrasonically welded joined to essentially form a single sheet. The layers 310 and 320 can be imprinted with logos or designs (not shown) in accordance with user preference. The layers 310 and 320 of the flag 300 can be formed from pliable translucent material such as plastic sheeting such that LED lights (not shown)

between the layers 310 and 320 can shine through an illuminate the flag 300. The layers 310 and 320 can alternatively be formed from fabric or fabric like material which can be sewn together.

Figure 2:
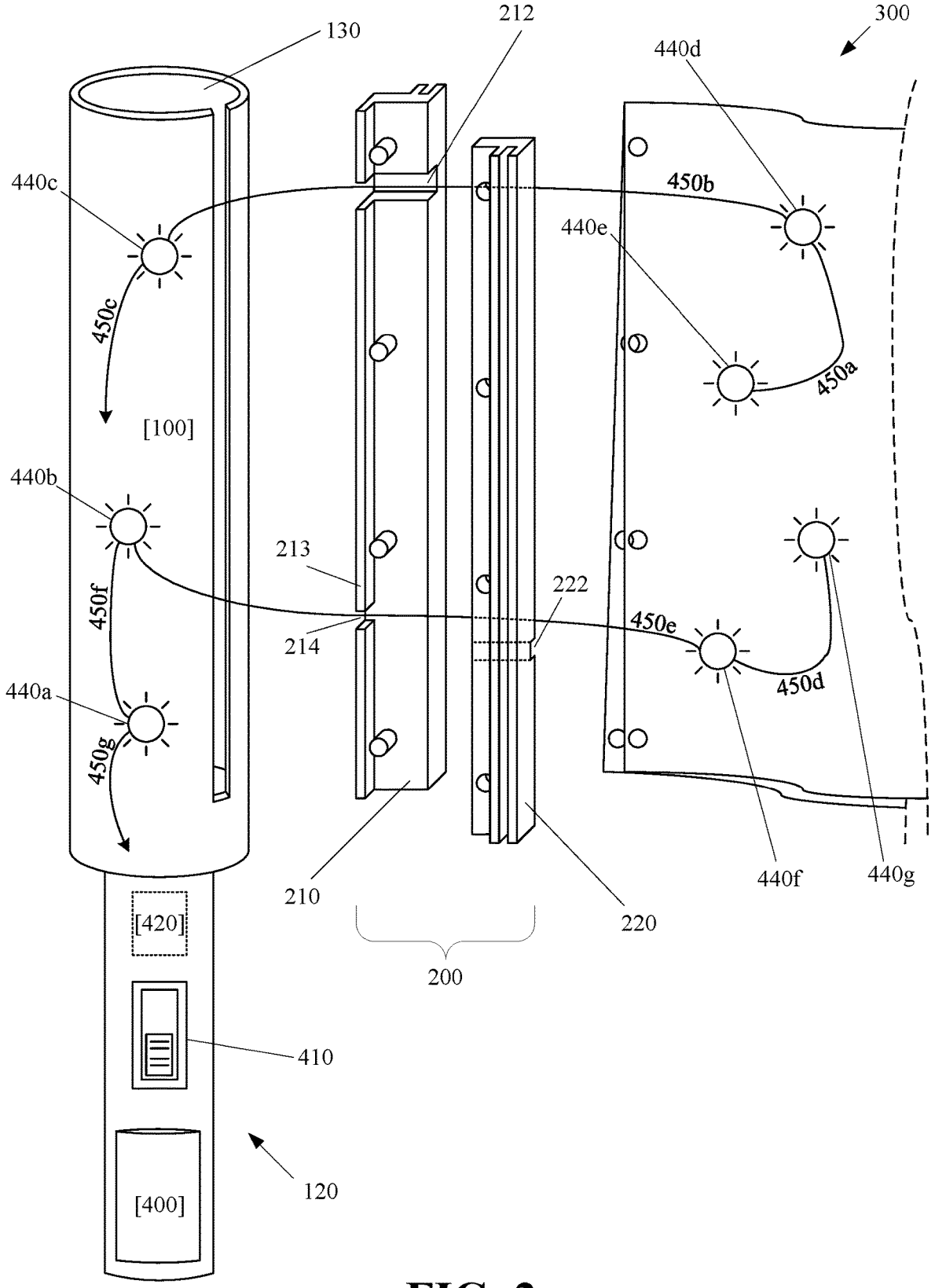
FIG. 2 is an exploded view of electrical components of an illuminated flag according to an exemplary embodiment of the invention.

FIG. 2 is an exploded view of electrical components of an illuminated flag according to an exemplary embodiment of the invention. As shown in FIG. 2, an illuminated flag includes a flagpole 100, a flag clamp 200, flag 300, lights 440*a*-440*g*, and wires 450*a*-450*g*. A handle 120 of the flagpole 100 can include batteries 400, switch 410, and controller 420.

The switch 410 can selectively allow electrical power to pass from the batteries 400 to the controller 420. The controller 420 can be an LED driver. The controller 420 can modulate the lights 440*a*-440*g* according to a program such as flashing, blinking, running, or simply on or off. Embodiments of the invention optionally omit the controller 420 in which case the lights 440*a*-440*g* can be directly connected to the battery 400 through switch 410. The switch 410 can be a slider switch as illustrated in FIG. 1. Alternatively, the switch 410 can be a push-on-push-off switch or a momentary push switch.

The lights 440*a*-440*g* can be LEDs. The lights 440*a*-440*g* can be disposed in the flag 300 and the flagpole 100. The lights 440*d*-440*g* in the flag can be disposed between layers of the flag. In embodiments of the invention the lights 440*d*-440*g* in the flag can be completely covered by the layers of the flag 300. When illuminated, the lights 440*d*-440*g* in the flag can shine through and illuminate the flag 300. The lights 440*d*-440*g* in the flag can be secured in place by ultrasonic welding or glue. Although the embodiment shown in FIG. 2 illustrates four lights in the flag 300 and three lights in the pole 100, this embodiment should be interpreted as illustrative only and the invention is not limited by the number or arrangement of lights in the flag 300 or the pole 100.

Lights 440*f* and 440*g* in the flag can received power via electrical wires. In the embodiment of FIG. 2, electrical wire 450*g* can connect to the battery 400 via switch 410 or controller 420. Electrical wire 450*g* can connect to light 440*a* in the flagpole 100. Electrical wire 450*f* can connect light 440*a* to light 440*b*. Electrical wire 450*e* can connect light 440*b* to light 440*f*. Electrical wire 450*d* can connect light 440*f* to light 440*g*. In one embodiment of the invention, electrical wire 450*e* can be routed from the flag 300 into the flagpole 100 through the flag clamp 200. The flag clamp 200 can include a notch 222 and discontinuous portion 214 to allow the electrical wire 450*e* to pass through the flag clamp 200. Other embodiments of the invention may omit notch 222 and include only discontinuous portion 214. In these embodiments, the wires can be thin and flag clamp can flex slightly to allow the wire to pass between the first and second members 210 and 220 of the flag clamp 200.

Lights 440*d* and 440*e* in the flag 300 can received power via electrical wires. In the embodiment of FIG. 2, electrical wire 450*c* can connect to the battery 400 via switch 410 or controller 420. Electrical wire 450*c* can connect to light 440*c* in the flagpole 100. Electrical wire 450*b* can connect light 440*c* to light 440*d*. Electrical wire 450*a* can connect light 440*c* to light 440*d*. In one embodiment of the invention, electrical wire 450*b* can be routed from the flag 300 into the flagpole 100 through the flag clamp 200. The flag clamp 200 can include a notch 212 to allow the electrical wire 450*b* to pass through the flag clamp 200. Other embodiments of the invention may omit notch 212 and wire 450*b* can be routed through the flag clamp 200 without a specific channel. In these embodiments, the wires can be thin and flag clamp can flex slightly to allow the wire to pass between the first and second members 210 and 220 of the flag clamp 200.

The embodiment of FIG. 2 illustrates substantially two circuits of lights for illustrative purposes only. Preferred embodiments of the invention include just a single circuit for simplicity. Alternative embodiments of the invention include a first circuit in the flagpole 100 and a second circuit in the flag 300. In such embodiments, the controller 420 can selectively toggle the lights in the flag and the flagpole.

Figure 3:
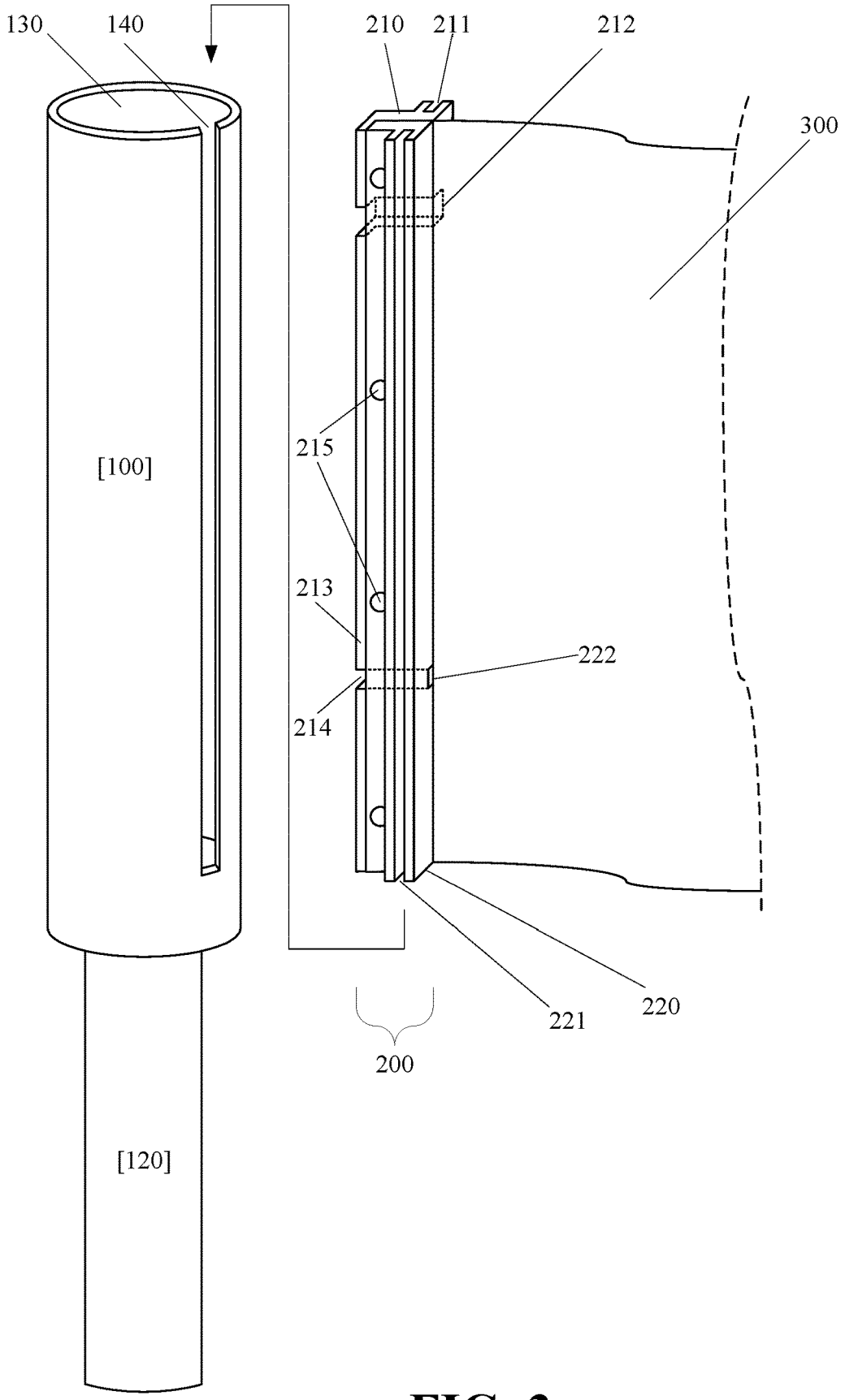
FIG. 3 is an assembly view of an illuminated flag according to an exemplary embodiment of the invention.

FIG. 3 is an assembly view of an illuminated flag according to an exemplary embodiment of the invention. As shown in FIG. 3, an illuminated flag includes a pole 100, a flag clamp 200, and a flag 300. The flag clamp can include a first member 210 and a second member 220. An edge of the flag 300 can be sandwiched in the flag clamp 200 between the first member 210 and the second member 220. A plurality of engaging features 215 can lock the first member 210 and the second member 220. The engaging features 215 can be upstanding pillars.

When assembled, the flag clamp 200 can have two wire routes from the flag traversing the clamp 200. A first wire route can be formed by notch 212. The notch 212 can receive a wire (e.g. wire 450*b*, FIG. 2). A second wire route can be formed by notch 222 and discontinuous portion 214. The second wire route can receive a wire (e.g. wire 450*e*; FIG. 2). The wire routes can allow electrical power to pass from the hollow interior 130 of the flagpole 100 into the flag 300 to power lights (not shown).

The flag clamp 200 can have grooves 211 and 221 extending longitudinally on opposite sides of the flag clamp 200. The grooves can have a width that is approximately the same as a thickness of a sidewall of the flagpole 100. The flagpole 100 can have a longitudinal slot 140 that is approximately the width of the flag clamp as measured between the grooves 211 and 221. The grooves 211 and 221 can be engaged onto the slot 140 such that the sidewalls of the slot 140 slide within the grooves 211 and 221 so that the flag clamp 200 can be slidably introduced into the flagpole 100. When slidably engaged in the slot 140 of the flagpole, a portion of the flag clamp 200 can be disposed on an exterior of the flagpole 100 and a portion of the flag clamp 200 can be disposed on a hollow interior 130 of the flagpole 100. A cap (not shown) can be attached to the top of the flagpole 100 to prevent the flag clamp 200 from being removed. Optional handle 120 of the flagpole 100 is preferably sized in approximate proportions to a human hand so that the flag may be easily carried.

Figure 4:
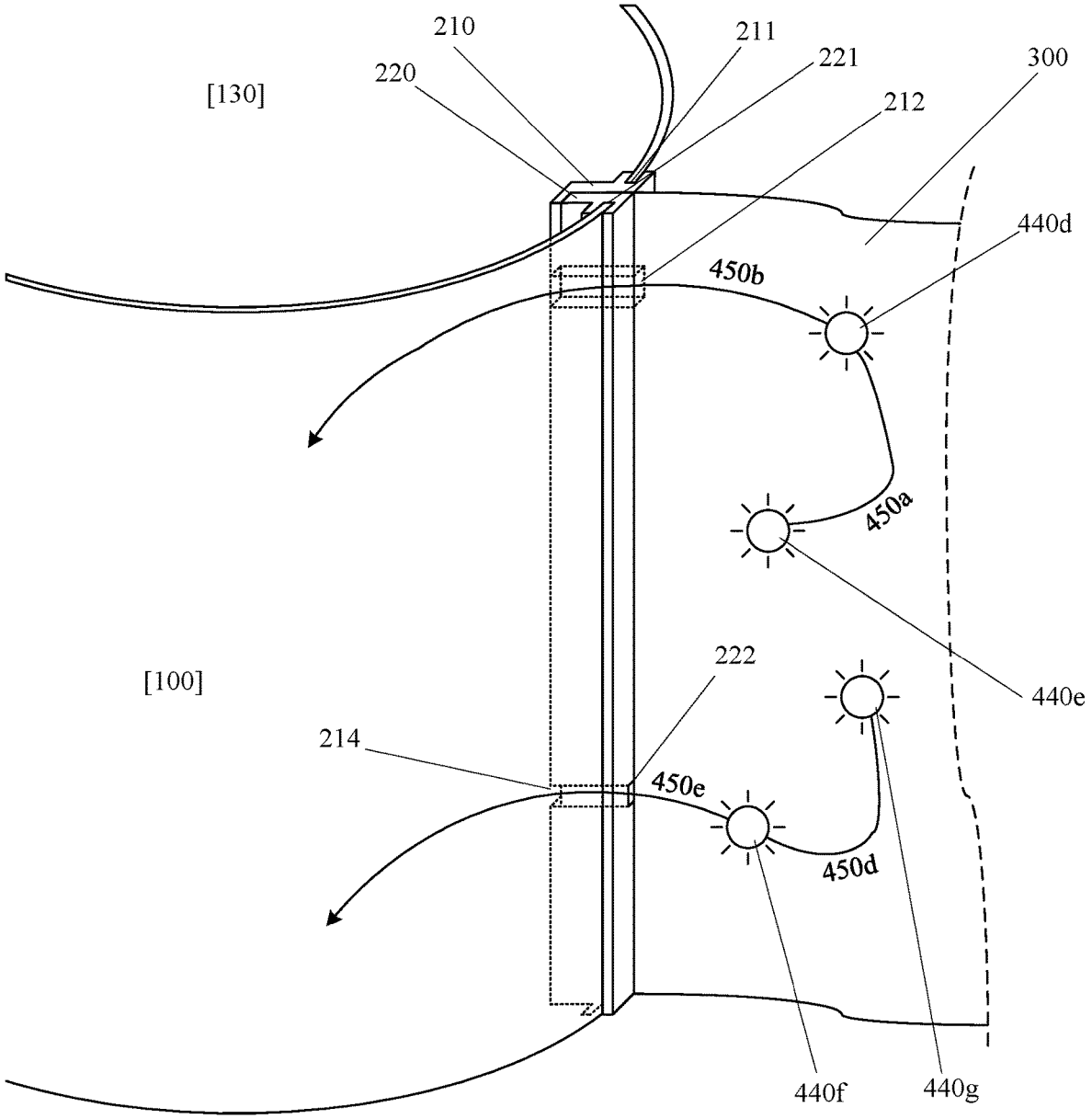
FIG. 4 is a detailed view of an illuminated flag according to an exemplary embodiment of the invention.

FIG. 4 is a detailed view of an illuminated flag according to an exemplary embodiment of the invention. As shown in FIG. 4, an illuminated flag includes a pole 100, a flag clamp 200, and a flag 300. The flag clamp 200 can include a first member 210 and a second member 220. An edge of the flag 300 can be sandwiched in the flag clamp 200 between the first member 210 and the second member 220. The flag clamp 200 can have grooves 211 and 221 extending longitudinally on opposite sides of the flag clamp 200. The grooves can have a width that is approximately the same as a thickness of a sidewall of the flagpole 100. The flagpole 100 can have a longitudinal slot (not labeled) that is approximately the width of the flag clamp as measured between the grooves 211 and 221. The grooves 211 and 221 can be engaged onto the slot such that the sidewalls of the slot slide within the grooves 211 and 221 so that the flag clamp 200 can be slidably introduced into the flagpole 100. When slidably engaged in the slot of the flagpole, a portion of the flag clamp 200 can be disposed on an exterior of the flagpole 100 and a portion of the flag clamp 200 can be disposed on a hollow interior 130 of the flagpole 100. A cap (not shown) can be attached to the top of the flagpole 100 to prevent the flag clamp 200 from being removed.

When assembled, the flag clamp 200 can have two wire routes from the flag traversing the clamp 200. A first wire route can be formed by notch 212. The notch 212 can receive a wire 450*b* which in turn provides electrical power to lights 440*d* and 440*e*. A second wire route can be formed by notch 222 and discontinuous portion 214. The second wire route can receive a wire 450*e* which in turn provides electrical power to lights 440*f* and 440*g*. The wire routes can allow electrical power to pass from the hollow interior 130 of the flagpole 100 into the flag 300 to power lights 440*d*-440*g*. It should be noted that while wires in the figures have been illustrated as a single line, those of skill in the art will appreciate that the lines are representative of wires that may have many conductors including, for example, a positive and negative conductor. It should further be noted that while embodiments of the invention illustrated in FIGS. 1-4 show a device having two wire routes, it is completed and accordingly within the scope of the invention for devices to have just a single wire route or varying combinations of two or more wire routes. For example, in small flags, it may be sufficient to have just a single wire route. Alternatively, in large flags, it may be advantageous to have multiple wire routes to reduce the load on the wires.

Figure 5:
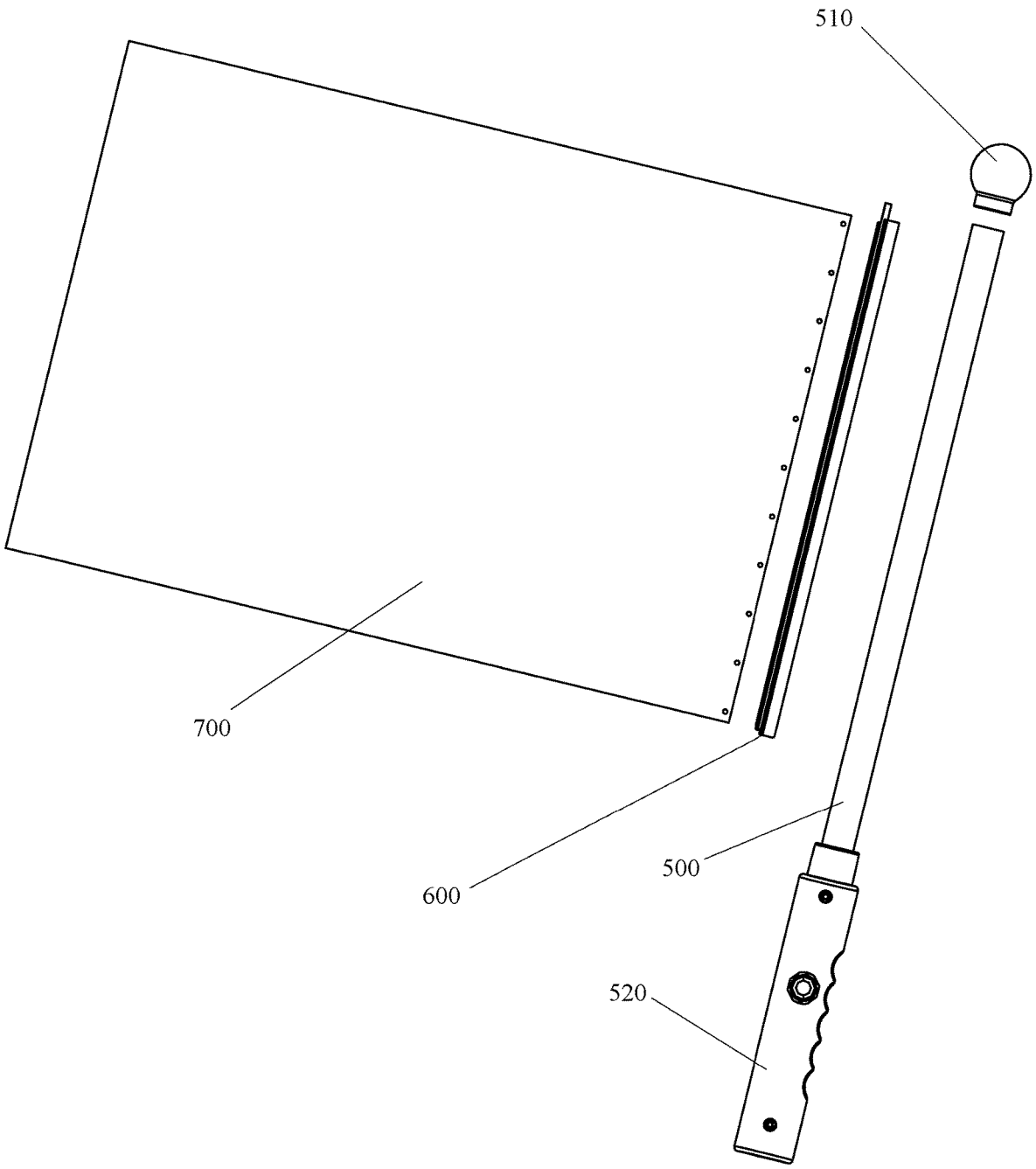
FIG. 5 is an exploded view of mechanical components of an illuminated flag according to an exemplary embodiment of the invention.
Figure 6:
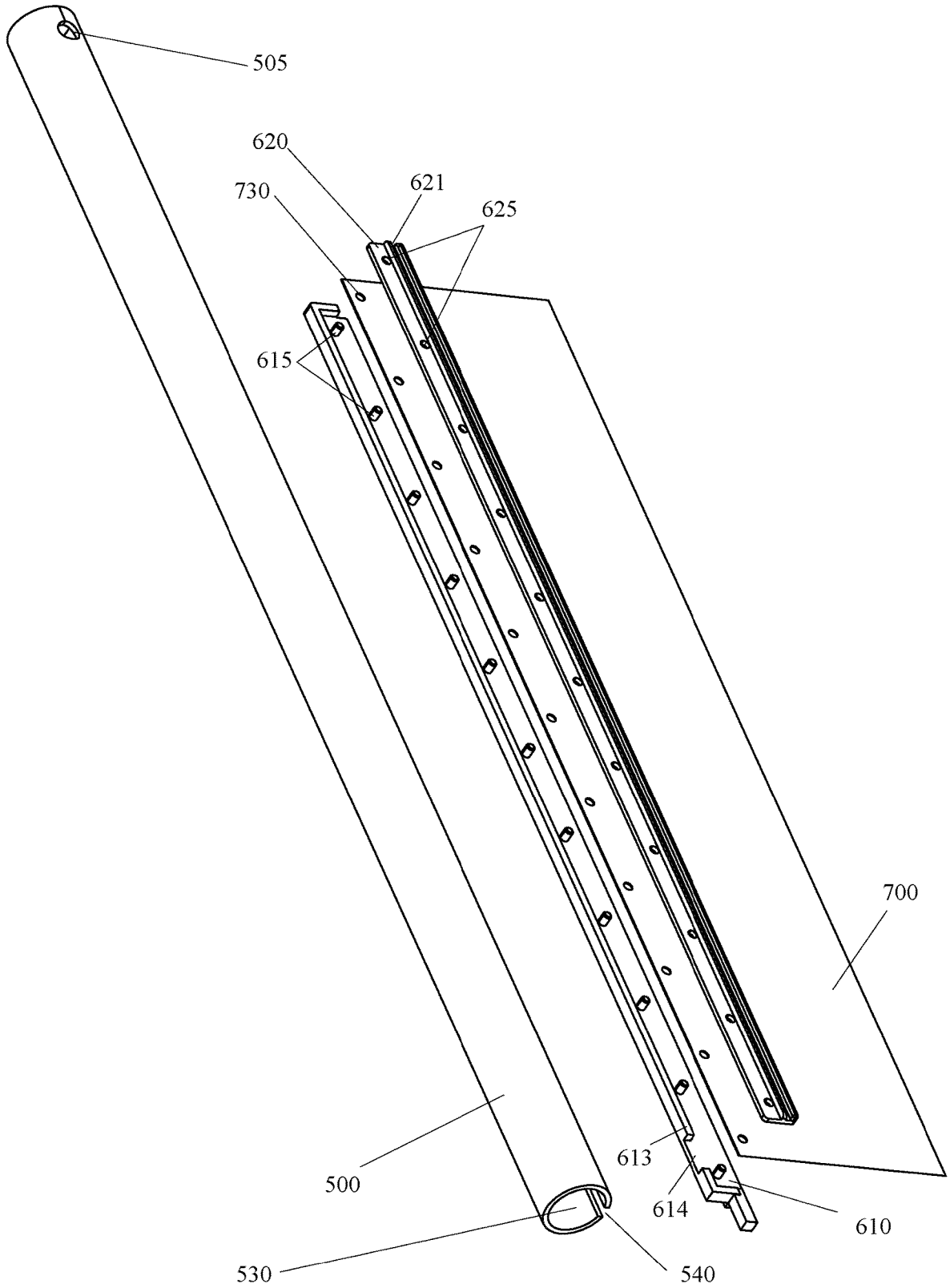
FIG. 6 is an exploded view of mechanical components of an illuminated flag according to an exemplary embodiment of the invention.

FIG. 5 is an exploded view of mechanical components of an illuminated flag according to an exemplary embodiment of the invention and FIG. 6 is an exploded view of mechanical components of an illuminated flag according to an exemplary embodiment of the invention. As shown in FIG. 5 and FIG. 6, an illuminated flag can include a flagpole 500, flag clamp 600, and a flag 700. The flagpole 500 can include a handle 520, a cap 510, a hollow interior 530, and a longitudinal slot 540 extending substantially the length of the flagpole 500. A hole 505 can be provided to receive a fastener (not shown) for attaching the handle 520 to the flagpole 500. The flag clamp 600 can formed from substantially two elongated clamp members 610 and 620. The first clamp member 610 can have a plurality of upstanding members 615. The second clamp member 620 can have a plurality of mating features 625 that are disposed in approximate location and sized in approximate proportions to interface with the plurality of upstanding members 615 on the first clamp member 610. The flag clamp 600 can have a spine 613 and can provide rigidity to the flag clamp 600.

The flag clamp 600 can have a discontinuous portion 614. The discontinuous portion 614 can provide a space for an electrical wire to pass through the flag clamp 600 without becoming unnecessarily kinked or bent thereby saving potential damage to the wire.

The flag 700 can have an engaging portion 730 that has features that are disposed in relative position and formed in relative size to interface with the upstanding members 615 and mating members 625. When assembled, the engaging portion 730 of the flag 700 can be retained in the flag clamp 600 by the combination of upstanding members 615 and mating members 625.

The second member 620 of the flag clamp 600 can have a longitudinal channel 621. The first member 610 of the flag clamp 600 can also have a longitudinal channel (not shown) in much the same configuration as discussed in conjunction with FIG. 1 (element 211). When assembled, the flag clamp 600 can be slidably introduced into the longitudinal slot 540 of the flagpole 500 such that the longitudinal channels of the flag clamp 600 engage the side walls of the longitudinal slot 540. The flag clamp 600 can be retained in the longitudinal slot 540 by attaching the cap 510.

The illustrations of FIG. 5 and FIG. 6 omit the electrical structure of the lights and the two-layers of the flag for simplicity of illustration. Those of skill in the art will appreciate that the structure of the flag 700 and electronics can be provided in much the same way as discussed in conjunction with FIG. 2 and FIG. 4.

Figure 7:
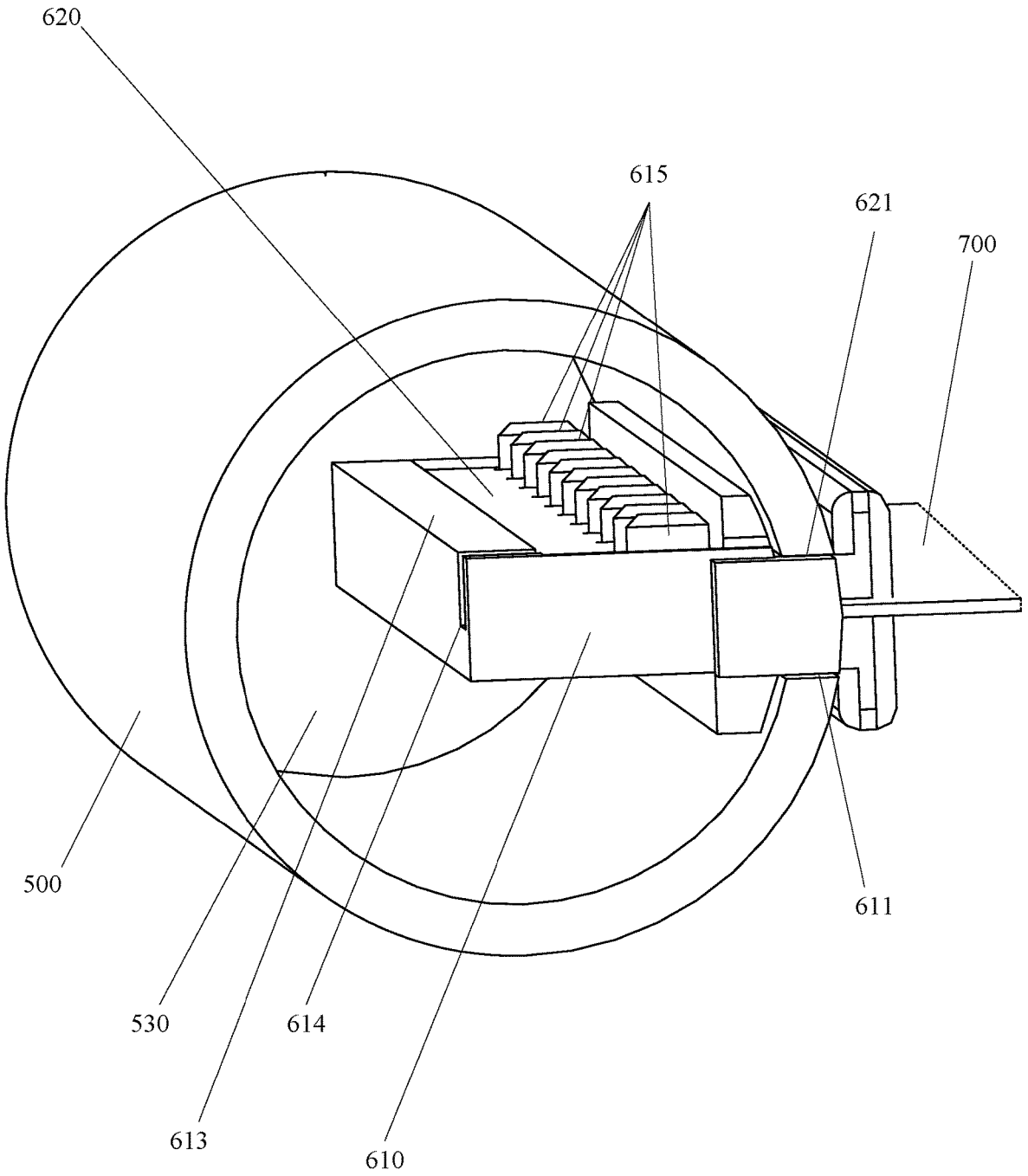
FIG. 7 is a top view of an assembled illuminated flag according to an exemplary embodiment of the invention.

FIG. 7 is a top view of an assembled illuminated flag according to an exemplary embodiment of the invention. As shown in FIG. 7, an illuminated flag includes a flagpole 500, a flag clamp 600, and a flag 700. The flag 700 is sandwiched between two halves 610 and 620 of the flag clamp 600. Upstanding members 615 of the first member 610 of the flag clamp 600 are shown engaged with the mating features (not labeled) of the second member 620 of the flag clamp 600. In the embodiment illustrated in FIG. 7, the upstanding members 615 are pillars on the first member 610 of the flag clamp 600 that engage corresponding holes on the second member 620 of the flag clamp 600. In this way, the first and second members 610 and 620 of the flag clamp are joined together. The upstanding members 615 can optionally be melted to more permanently join the two halves together.

The flag clamp 600 has been slidably inserted into the longitudinal slot (FIG. 6, element 540) of the flagpole 500. The longitudinal channels 621 and 611 of the flag clamp 600 engage the sidewalls of the longitudinal slot of the flagpole 500. The flag clamp 600 can optionally have a spine 613 for stiffening the flag clamp 600. The flag clamp 600 have a discontinuous portion 614 to allow for a wire (not shown) from the flag 700 to be passed though the flag clamp 600 and into the hollow interior 530 of the flagpole 500 where the wire can be connected to the other electronics and a power supply.

Figure 8:
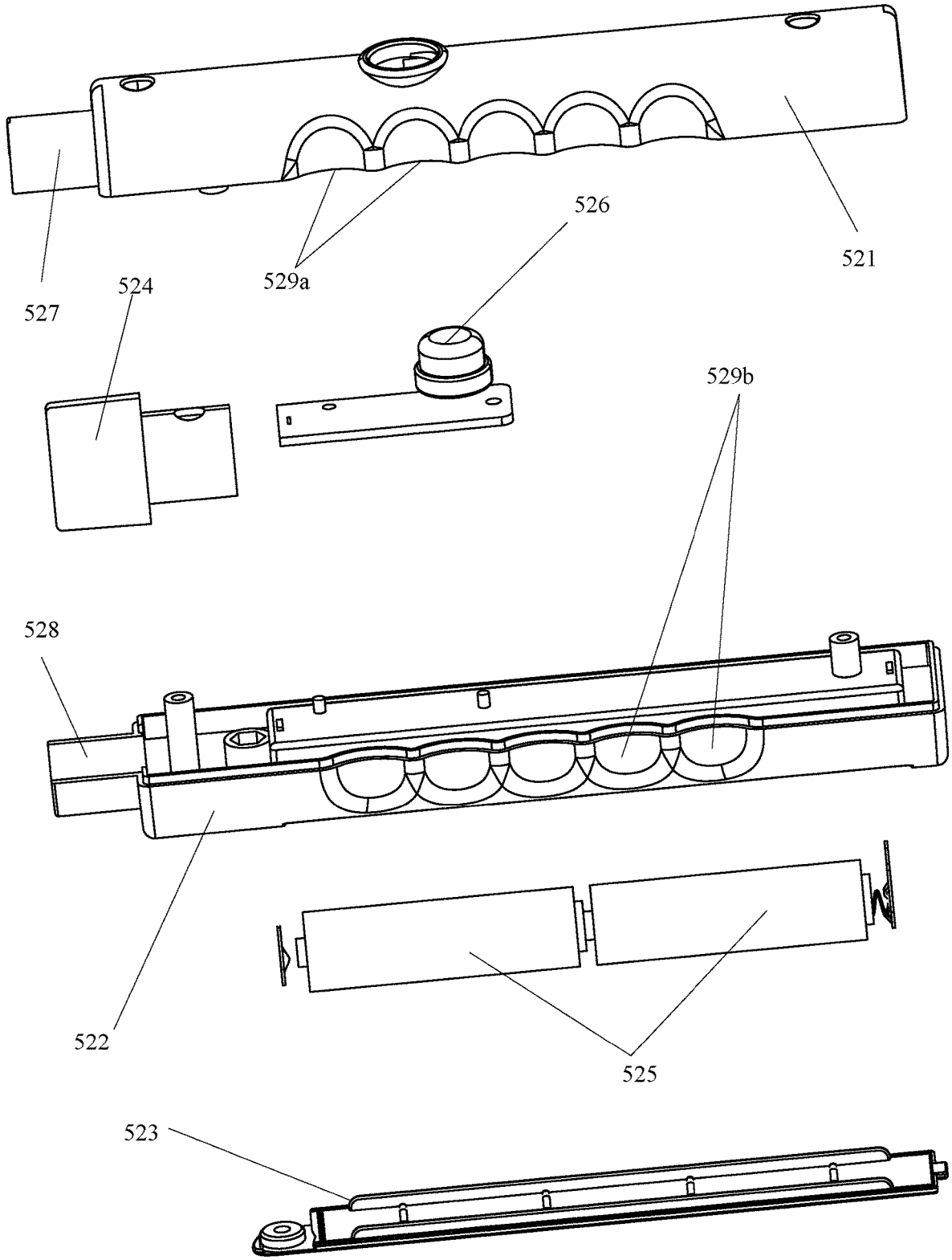
FIG. 8 is an exploded view of a handle of an illuminated flag according to an exemplary embodiment of the invention.

FIG. 8 is an exploded view of a handle of an illuminated flag according to an exemplary embodiment of the invention. As shown in FIG. 8, a handle of an illuminated flag can generally include electronics for operating the illuminated flag. The handle can be formed primarily from a first half 521 and a second half 522 that are joined together to form the main body of the handle. The first half 521 and second half 522 can include scalloped portions 529*a* and 529*b* (respectively). The first half 521 and second half 522 can include narrow top portions 527 and 528 (respectively.) When assembled, a ferrule 524 can cap the first half 521 and second half 522. A switch 526 can be connected to batteries 525. A battery door 523 can retain the batteries inside the handle. In the embodiment of FIG. 8, the switch 526 is illustrated as a push button. It should be appreciated, however, that other types of switches are contemplated and within the scope of the invention.

The switch 526 can be electrically connected to batteries 525 and lights in the body of the flagpole and the flag. The switch can optionally be connected to a controller (e.g. FIG. 2, element 420) for providing varied illumination of the lights in the flag and the pole. For example, when the flag is in an "off" state, a momentary press of the switch 526 can cause the controller to toggle the device to an "on" state where the lights in both the flag and the handle are illuminated. A second press of the switch 526 can cause the controller to toggle the device to another "on" state where the lights in only the flag are illuminated. A third press of the switch 526 can cause the controller to toggle the device to yet another "on" state where the lights in only the flagpole are illuminated. A fourth press of the switch 526 can cause the controller to toggle the device to still another "on" state where the lights in the flag and the flagpole blink or "run".

In still further states, other lighting behavior can be achieved by the controller by varying presses of the switch 526. A final state can turn off all the lights.

It will be apparent to those skilled in the art that various modifications and variations can be made in the illuminated flag without departing from the spirit or scope of the invention. Thus, it is intended that embodiments of the invention cover the modifications and variations of this invention provided they come within the scope of the appended claims and their equivalents.

What is claimed is:

1. A lighted flag comprising:
a flagpole;
a flag;
a first layer of the flag;
a second layer of the flag;
a light disposed between the first layer of the flag and a second layer of the flag;
a flag clamp; and
a wire extending from the light into an interior space of the flagpole.

2. The lighted flag of claim 1 further comprising:
a notch in the flag clamp; and
wherein the wire passes through the notch in the flag clamp.

3. The lighted flag of claim 1 further comprising:
a first part of the flag clamp;
a second part of the flag clamp;
a plurality of upstanding members on the first part of the flag clamp; and
a plurality of mating members on the second part of the flag clamp mated with the plurality of upstanding members.

4. The lighted flag of claim 2 further comprising:
an engaging portion the flag mated with the plurality of upstanding members on the first part of the flag clamp.

5. The lighted flag of claim 4 wherein the engaging portion of the flag is sandwiched between the first part of the flag clamp and the second part of the flag clamp.

6. The lighted flag of claim 1 further comprising:
a first longitudinal channel in the flag clamp;
a second longitudinal channel in the flag clamp;
a slot longitudinally disposed in the flagpole; and
wherein the first longitudinal channel and the second longitudinal channel are slidably received in the slot.

7. The lighted flag of claim 1 further comprising:
a top of the flagpole;
a slot longitudinally disposed in a side of the flagpole;
a hollow portion of the flagpole open to the top and the slot;
a cap on the top of the flagpole; and
wherein the flag clamp is slidably received in the slot and retained by cap.

8. The lighted flag of claim 1 further comprising:
a power supply disposed in the flagpole; and
wherein the power supply is connected to the wire extending from the light in the flag.

9. A lighted flag comprising:
a flagpole, the flagpole having a hollow interior;
a flag, the flag being at least partially translucent;
a first layer of the flag;
a plurality of lights disposed on the first layer of the flag;
an anchor connecting the flag to the flagpole;
a wire for providing power to the plurality of lights; and
wherein the wire is routed from the flag into the hollow interior of the flagpole.

10. The lighted flag of claim 9 further comprising:
a discontinuous portion of the anchor; and
wherein the wire is routed through the discontinuous portion of the anchor.

11. The lighted flag of claim 9 wherein the wire is substantially concealed between the first layer and a second layer of the flag.

12. The lighted flag of claim 9 further comprising:
a first side of the anchor;
a second side of the anchor;
a longitudinal slot of the flagpole; and
wherein the anchor is disposed in the longitudinal slot of the flagpole.

13. The lighted flag of claim 9 further comprising:
a first portion of the anchor;
a second portion of the anchor; and
wherein the first portion of the anchor and the second portion of the anchor cooperate to sandwich the flag therebetween.

14. The lighted flag of claim 9 further comprising:
a plurality of protrusions of the anchor; and
a plurality of mating portions of the flag disposed in relative position to interface with the protrusions.

15. The lighted flag of claim 9 further comprising:
a top of the flagpole, the top open to the hollow interior;
a cap for the top of the flagpole;
a longitudinal slot in a side of the flagpole and extending through the top of the flagpole; and
wherein the anchor is slidably received in the slot and partially retained by the cap.

16. The lighted flag of claim 15 further comprising:
a first channel on the anchor;
a second channel on an opposite side of the anchor; and
wherein the first and second channels cooperate to slidably retain the anchor within the longitudinal slot.

17. A lighted flag comprising:
a hollow flagpole;
a flag formed from two layers of material;
a first layer of the flag;
a second layer of the flag;
a light disposed between the first layer and the second layer of the flag;
an anchor connecting the flag to the flagpole;
a slot in the flagpole retaining the anchor;
a protrusion of the anchor;
a mating portion of the flag disposed in relative position to correspond to the protrusion of the anchor and secure the flag to the anchor; and
a wire connected to the light, the wire substantially obscured between the first and second layers of the flag.

18. The lighted flag of claim 17 further comprising:
a notch of the anchor; and
wherein the wire is routed through the notch of the anchor into the hollow flagpole.

19. The lighted flag of claim 17 wherein a portion of the flag is disposed inside the flagpole.

20. The lighted flag of claim 17 further comprising:
a top of the flagpole;
a cap of the flagpole; and
wherein the anchor is slidably retained in the slot of the flagpole by the cap.

* * * * *